US007413184B2

(12) United States Patent
Lai

(10) Patent No.: US 7,413,184 B2
(45) Date of Patent: Aug. 19, 2008

(54) PICKUP MECHANISM FOR A BUSINESS MACHINE

(75) Inventor: Chung-Yi Lai, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 232 days.

(21) Appl. No.: 11/297,555

(22) Filed: Dec. 7, 2005

(65) Prior Publication Data

US 2007/0018378 A1 Jan. 25, 2007

(30) Foreign Application Priority Data

Jul. 19, 2005 (TW) ..... 94124289 A

(51) Int. Cl.
*B65H 3/06* (2006.01)

(52) U.S. Cl. ..... 271/117

(58) Field of Classification Search ..... 271/109, 271/114, 117, 118

See application file for complete search history.

(56) References Cited

U.S. PATENT DOCUMENTS

| | | | | |
|---|---|---|---|---|
| 4,718,655 | A * | 1/1988 | Okayama et al. | 271/3.08 |
| 5,622,364 | A * | 4/1997 | Dutton et al. | 271/117 |
| 6,318,715 | B1 * | 11/2001 | Froechte et al. | 271/117 |
| 6,322,065 | B1 * | 11/2001 | Underwood et al. | 271/117 |
| 6,637,743 | B2 * | 10/2003 | Underwood et al. | 271/117 |
| 6,736,389 | B2 * | 5/2004 | Kosmoski | 271/116 |
| 2005/0263954 | A1 * | 12/2005 | Worley et al. | 271/114 |

* cited by examiner

*Primary Examiner*—Patrick Mackey
*Assistant Examiner*—Michael C McCullough
(74) *Attorney, Agent, or Firm*—Quintero Law Office

(57) ABSTRACT

A pickup mechanism for a business machine. A support shaft is disposed in the business machine. An oscillating arm includes a first end and a second end opposite thereto. The first end is fitted on the support shaft. An inner-rotor type motor is disposed on the second end of the oscillating arm and includes a central rotating shaft extending beyond the inner-rotor type motor. A pickup roller is connected to the central rotating shaft. When the inner-rotor type motor operates, the pickup roller rotates by rotation of the central rotating shaft.

6 Claims, 4 Drawing Sheets

200

PICKUP MECHANISM FOR A BUSINESS MACHINE

BACKGROUND

The invention relates to a pickup mechanism, and in particular to a simplified pickup mechanism for a business machine.

A conventional printer or business machine often comprises an automatic print media feed device. The automatic print media feed device comprises a pickup mechanism, a separating mechanism, a feed mechanism, and an eject mechanism.

In a conventional pickup mechanism, print media sheets are picked up dynamically, wherein a pickup roller continuously provides normal force to the print media sheets, creating friction between the pickup roller and the top print media sheet. Thus, when rotating, the pickup roller can transport the top print media sheet.

Referring to FIG. 1, a conventional pickup mechanism 1 comprises a drive motor 11, a deceleration gear train 12, a switch 13, a first rotating shaft 14, an oscillating arm 15, a one-way device 16, a second rotating shaft 17, and two pickup rollers 18. A rotating shaft of the driving motor 11 is connected to an input end (not shown) of the deceleration gear train 12. The first rotating shaft 14 is connected to an output end (not shown) of the deceleration gear train 12. One end of the oscillating arm 15 is fitted on the first rotating shaft 14 and the other on the second rotating shaft 17. The pickup rollers 18 are respectively fixed to two ends of the second rotating shaft 17. The first rotating shaft 14 is connected to the second rotating shaft 17 through a transmission belt (not shown, disposed in the oscillating arm 15).

Accordingly, when the drive motor 11 operates, initial rotational speed therefrom is reduced to a lower rotational speed by the deceleration gear train 12. The first rotating shaft 14 connected to the deceleration gear train 12 rotates at the lower rotational speed. By the transmission belt, the second rotating shaft 17 also rotates at the lower rotational speed. At this point, the pickup rollers 18 respectively fixed to ends of the second rotating shaft 17 also rotate at the lower rotational speed, thereby transporting the print media sheets (not shown). Moreover, the oscillating arm 15 can oscillate upward and downward about the first rotating shaft 14. The pickup rollers 18 can thus provide a normal force to the print media sheets, creating friction therebetween.

Moreover, the drive motor 11 or deceleration gear train 12, in some conventional business machines, is connected to a feed roller of a feed mechanism. The switch 13, such as a solenoid, switches the operating direction of the driving motor 11.

Referring to FIG. 2, when a pickup sensor 21 in a business machine 2 detects a print media sheet P, the drive motor 11 rotates the pickup rollers 18 counterclockwise, thereby picking up the print media sheet P. When the print media sheet P passes through a feed sensor 22, the feed sensor 22 outputs a signal to the switch 13. At this point, the switch 13 reverses the drive motor 11, such that the deceleration gear train 12 performs reverse reduction output. A feed roller 23 connected to the deceleration gear train 12 rotates clockwise to feed the print media sheet P. The pickup rollers 18, however, are also connected to the decelerating gear train 12. The one-way device 16 prevents the pickup rollers 18 from rotating clockwise when the deceleration gear train 12 performs reverse reduction output. Namely, because of the one-way device 16, the pickup rollers 18 can rotate only counterclockwise. The print media sheet P can thus be ensured in the business machine 2.

Accordingly, as the deceleration gear train 12 is composed of multiple gears, the pickup mechanism 1 is large, adversely affecting application inside the business machine 2 or undesirably increasing the size of the business machine 2 itself. Moreover, because of the deceleration gear train 12, one-way device 16, and switch 13, the pickup mechanism 1 is very complex.

SUMMARY

Accordingly, an embodiment of the invention provides a pickup mechanism for a business machine. The pickup mechanism comprises a support shaft, an oscillating arm, an inner-rotor type motor, and a pickup roller. The support shaft is disposed in the business machine. The oscillating arm comprises a first end and a second end opposite thereto. The first end is fitted on the support shaft. The inner-rotor type motor is disposed on the second end of the oscillating arm and comprises a central rotating shaft extending beyond the inner-rotor type motor. The pickup roller is connected to the central rotating shaft. When the inner-rotor type motor operates, the pickup roller rotates by rotation of the central rotating shaft.

The pickup mechanism further comprises a frictional pad covering the pickup roller.

The frictional pad is rubber.

The first end of the oscillating arm is rotatably fitted on the support shaft.

The support shaft is rotatably disposed in the business machine.

The central rotating shaft of the inner-rotor type motor parallels the support shaft.

The inner-rotor type motor comprises a stepping motor.

DESCRIPTION OF THE DRAWINGS

The invention can be more fully understood by reading the subsequent detailed description and examples with references made to the accompanying drawings, wherein.

DETAILED DESCRIPTION

First Embodiment

Figure 1:
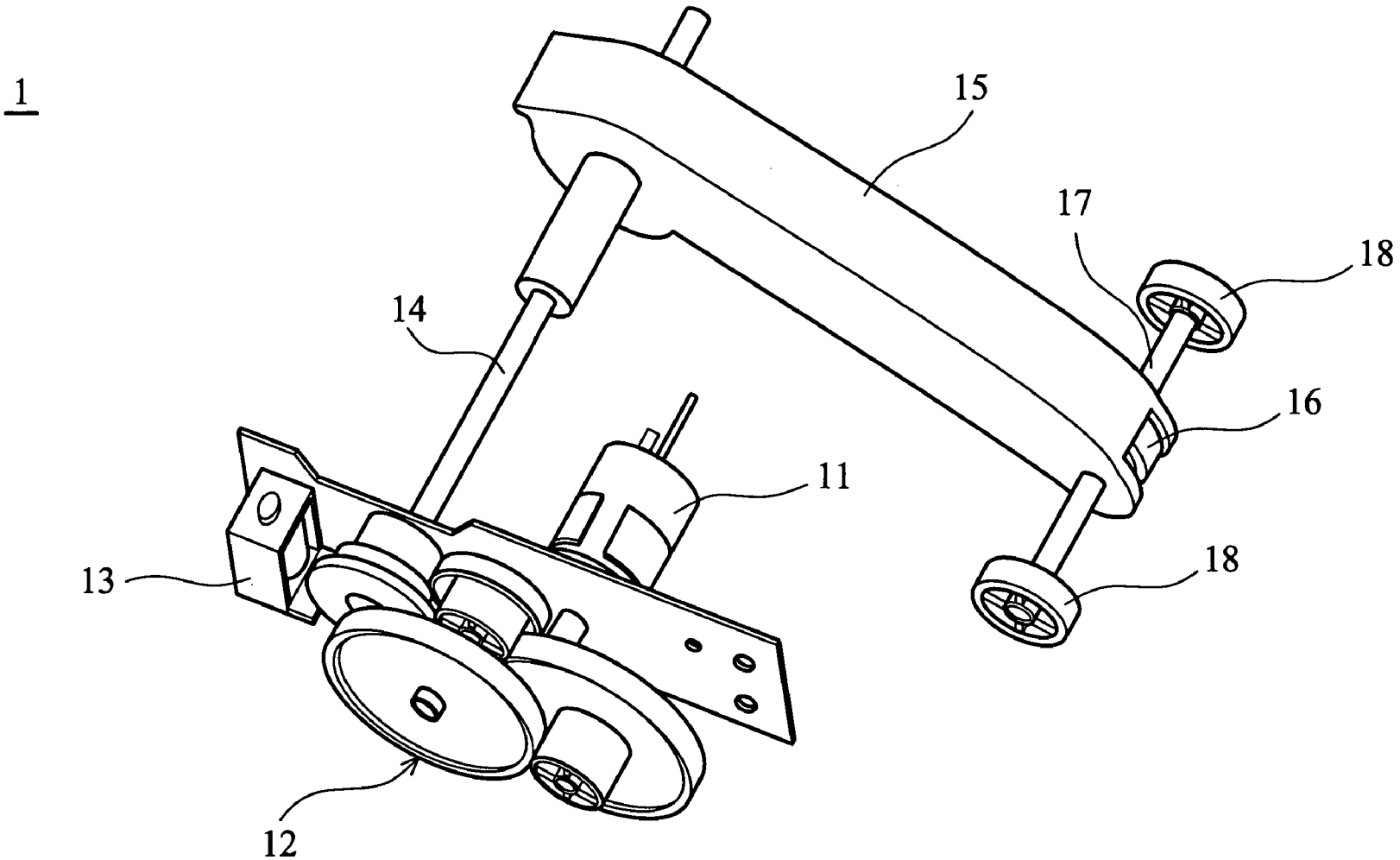
FIG. 1 ( RELATED ART )
FIG. 1 is a schematic perspective view of a conventional pickup mechanism.
Figure 2:
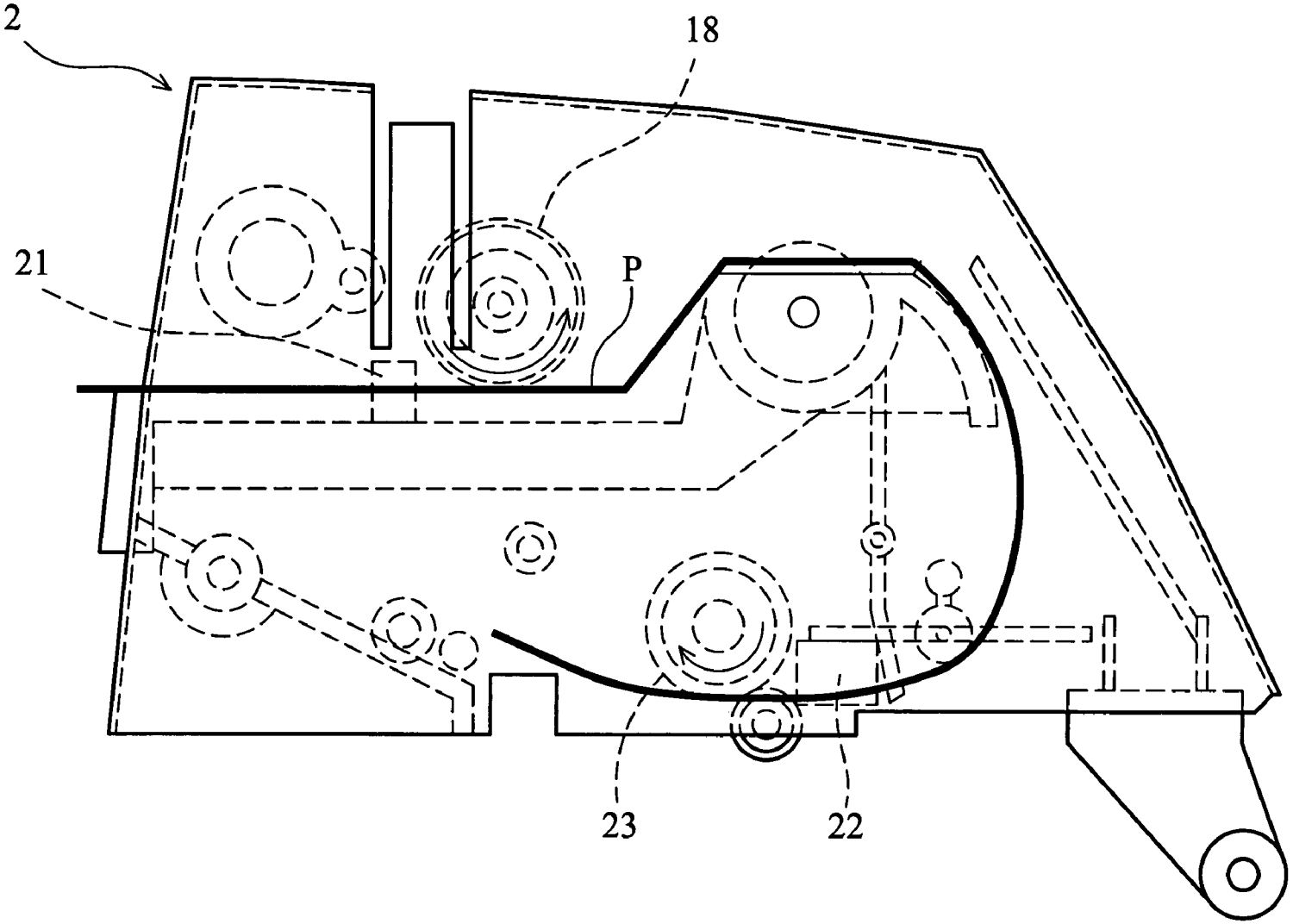
FIG. 2 ( RELATED ART )
FIG. 2 is a schematic view of the inner structure of a conventional business machine.
Figure 3:
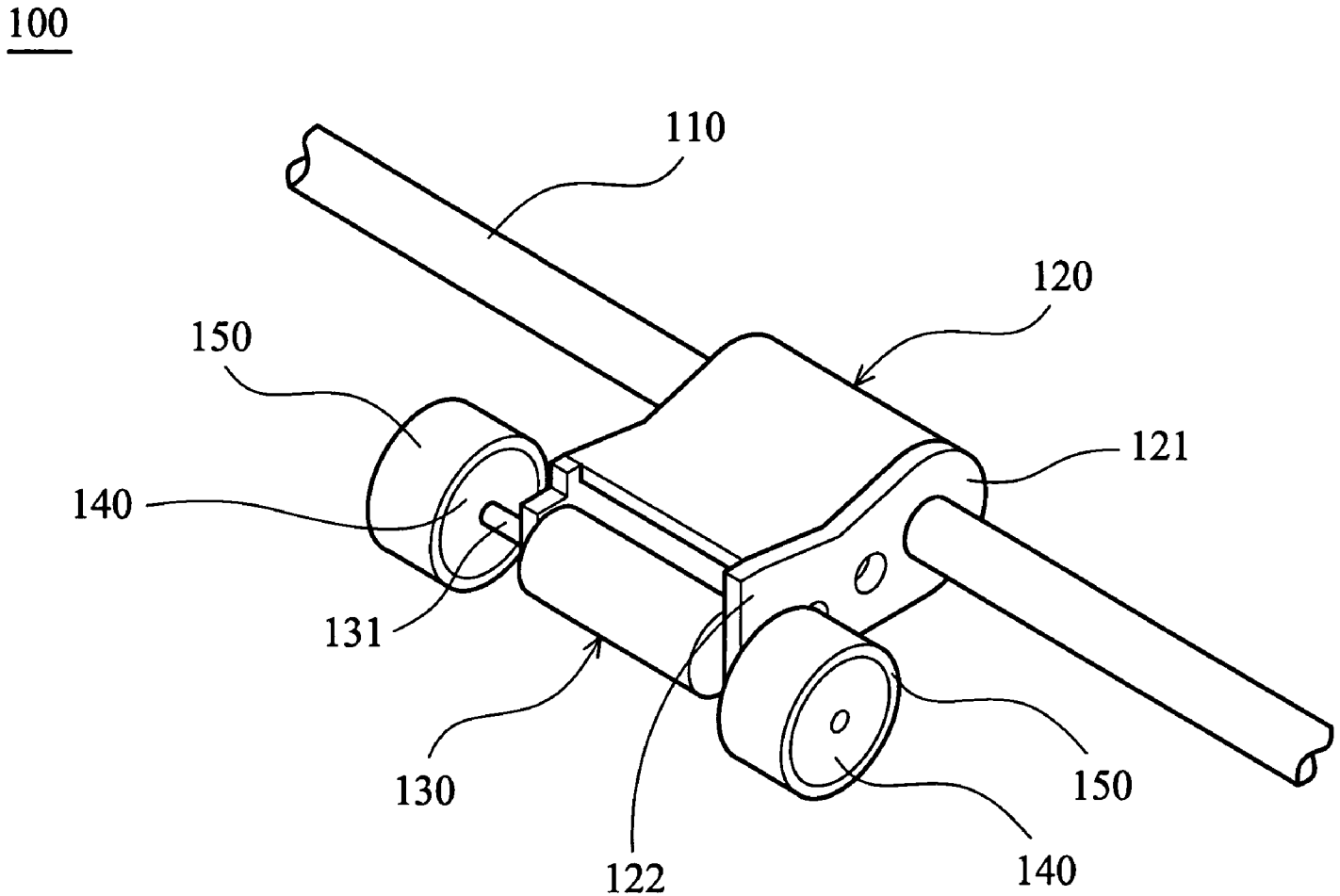
FIG. 3 is a schematic perspective view of the pickup mechanism of a first embodiment of the invention.

Referring to FIG. 3, the pickup mechanism 100 comprises a support shaft 110, an oscillating arm 120, an inner-rotor type motor 130, two pickup rollers 140, and two frictional pads 150.

The support shaft 110 can be disposed in a business machine. The oscillating arm 120 is fitted on the support shaft 110. Specifically, the oscillating arm 120 comprises a first end 121 and a second end 122 opposite thereto. The first end 121 is fitted on the support shaft 110.

The inner-rotor type motor 130 is disposed on the second end 122 of the oscillating arm 120 and comprises a central rotating shaft 131. The central rotating shaft 131 parallels the support shaft 110. Two ends of the central rotating shaft 131 penetrate the second end 122 of the oscillating arm 120 and extend beyond the inner-rotor type motor 130. Moreover, the inner-rotor type motor 130 may be a stepping motor.

The pickup rollers 140 are respectively connected to the ends of the central rotating shaft 131. The frictional pads 150 respectively cover the pickup rollers 140, increasing the coefficient of friction between the pickup rollers 140 and a print media sheet. Moreover, the frictional pads 150 may be rubber or a material with a high coefficient of friction.

Additionally, to enable the pickup mechanism 100 to dynamically pick up print media sheets, the pickup rollers 140 persistently provide a suitable normal force to the print media sheets, thereby creating friction between the pickup rollers 140 and the print media sheet. Specifically, the first end 121 of the oscillating arm 120 is rotatably fitted on the support shaft 110, or the support shaft 110 is rotatably disposed in a business machine, such that the pickup rollers 140 can provide a suitable normal force to the print media sheets by upward and downward oscillation of the oscillating arm 120. Furthermore, having a weight, the inner-rotor type motor 130 disposed on the second end 122 of the oscillating arm 120 inherently provides a normal force to the print media sheets.

Accordingly, when the pickup mechanism 100 is applied in a business machine, the pickup rollers 140 rotate directly by operation of the inner-rotor type motor 130, inputting the print media sheets to the business machine. A feed roller or feed mechanism disposed in the business machine can be driven by another motor. Moreover, when the inner-rotor type motor 130 is not applied with electricity, idling resistance thereof is minimal. Thus, even though carried by the feed roller and remaining in touch with the pickup rollers 140, the print media sheet is not subject to obvious resistance when passing through the pickup rollers 140.

Second Embodiment

Figure 4:
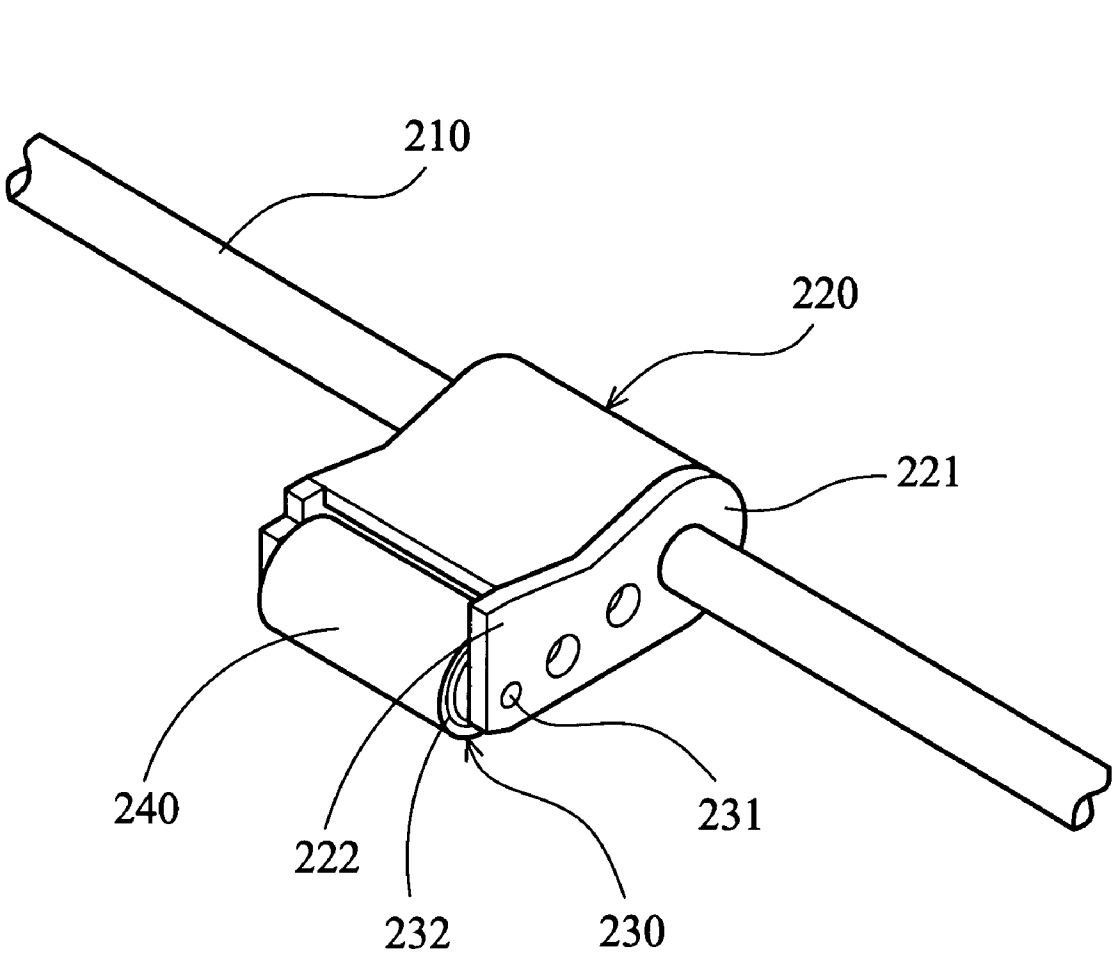
FIG. 4 is a schematic perspective view of the pickup mechanism of a second embodiment of the invention.

Referring to FIG. 4, the pickup mechanism 200 comprises a support shaft 210, an oscillating arm 220, an outer-rotor type motor 230, and a frictional pad 240.

The support shaft 210 is disposed in a business machine. The oscillating arm 220 is fitted on the support shaft 210. Specifically, the oscillating arm 220 comprises a first end 221 and a second end 222 opposite thereto. The first end 221 is fitted on the support shaft 210.

The outer-rotor type motor 230 is disposed on the second end 222 of the oscillating arm 220 and comprises a central shaft 231 and a housing 232. The central shaft 231 parallels the support shaft 210 and is fixed to the second end 222 of the oscillating arm 220. Specifically, the housing 232 serves as a pickup roller. Moreover, the outer-rotor type motor 230 may be a spindle motor.

The frictional pad 240 covers the housing 232 of the outer-rotor type motor 230, increasing the coefficient of friction between the housing 232 and a print media sheet. Similarly, the frictional pad 240 may be rubber or a material with a high coefficient of friction.

Similarly, to enable the pickup mechanism 200 to dynamically pick up print media sheets, the housing 232 persistently provide a suitable normal force to the print media sheets, thereby creating friction between the housing 232 and the print media sheet. Specifically, the first end 221 of the oscillating arm 220 is rotatably fitted on the support shaft 210, or the support shaft 210 is rotatably disposed in a business machine, such that the housing 232 can provide a suitable normal force to the print media sheets by upward and downward oscillation of the oscillating arm 220. Furthermore, having a weight, the outer-rotor type motor 230 disposed on the second end 222 of the oscillating arm 220 inherently provides a normal force to the print media sheets.

Accordingly, when the pickup mechanism 200 is applied in a business machine, the housing 232 rotates directly by operation of the outer-rotor type motor 230, inputting the print media sheets to the business machine. A feed roller or feed mechanism disposed in the business machine can be driven by another motor. Similarly, when the outer-rotor type motor 230 is not applied with electricity, idling resistance thereof is minimal. Thus, even though carried by the feed roller and remaining in touch with the housing 232 of the outer-rotor type motor 230, the print media sheet is not subject to obvious resistance when passing through the housing 232.

In conclusion, the disclosed pickup mechanisms disposed in a business machine eliminate the need for a deceleration gear train, a one-way device, and a switch. Thus, the inner structure of the business machine is simplified, and the size and manufacturing costs thereof reduced. Furthermore, as the disclosed pickup mechanisms operate directly by way of the inner-rotor type or outer-rotor type motor, the pickup speed of the business machine can be increased.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pickup mechanism for a business machine, comprising:

a support shaft disposed in the business machine;

an oscillating arm, with a first end and a second end opposite thereto, wherein the first end is fitted on the support shaft; and an outer-rotor type motor disposed on the second end of the oscillating arm and comprising a spindle motor, a central shaft, and a housing, wherein the central shaft is fixed to the second end of the oscillating arm, and the housing rotates by operation of the outer-rotor type motor.

2. The pickup mechanism as claimed in claim 1, further comprising a frictional pad covering the housing of the outer-rotor type motor.

3. The pickup mechanism as claimed in claim 2, wherein the frictional pad comprises rubber.

4. The pickup mechanism as claimed in claim 1, wherein the first end of the oscillating arm is rotatably fitted on the support shaft.

5. The pickup mechanism as claimed in claim 1, wherein the support shaft is rotatably disposed in the business machine.

6. The pickup mechanism as claimed in claim 1, wherein the central shaft of the outer-rotor type motor parallels the support shaft.

* * * * *